US009701321B2

(12) United States Patent
Arras

(10) Patent No.: US 9,701,321 B2
(45) Date of Patent: Jul. 11, 2017

(54) RAIL VEHICLE COMPRISING AN INNER TANK

(71) Applicant: SIEMENS AKTIENGESELLSCHAFT, Munich (DE)

(72) Inventor: Burkhard Arras, Krefeld (DE)

(73) Assignee: Siemens Aktiengesellschaft, Munich (DE)

( * ) Notice: Subject to any disclaimer, the term of this patent is extended or adjusted under 35 U.S.C. 154(b) by 185 days.

(21) Appl. No.: 14/420,420

(22) PCT Filed: Jul. 18, 2013

(86) PCT No.: PCT/EP2013/065158
§ 371 (c)(1),
(2) Date: Feb. 9, 2015

(87) PCT Pub. No.: WO2014/023546
PCT Pub. Date: Feb. 13, 2014

(65) Prior Publication Data

US 2015/0210296 A1 Jul. 30, 2015

(30) Foreign Application Priority Data

Aug. 7, 2012 (DE) ..... 10 2012 213 975 U

(51) Int. Cl.
*B61D 35/00* (2006.01)
*B61D 17/00* (2006.01)

(52) U.S. Cl.
CPC ..... *B61D 35/00* (2013.01); *B61D 17/00* (2013.01); *B61D 35/007* (2013.01); *Y10T 137/6869* (2015.04)

(58) Field of Classification Search
CPC ... B61D 5/00; B61D 5/02; B61D 5/06; B61D 35/00; B61D 35/005; B61D 35/007
See application file for complete search history.

(56) References Cited

FOREIGN PATENT DOCUMENTS

| | | | | |
|---|---|---|---|---|
| CN | WO 0160677 | * | 8/2001 | ..... B61D 35/00 |
| CN | 2513854 | Y | 10/2002 | |
| DE | 202011105321 | U1 | 11/2011 | |
| EP | 2572939 | A2 | 3/2013 | |
| FR | 2369134 | A1 | 5/1978 | |
| RU | 120060 | U1 | 9/2012 | |
| WO | 0160677 | A1 | 8/2001 | |

* cited by examiner

*Primary Examiner* — R. J. McCarry, Jr.
(74) *Attorney, Agent, or Firm* — Laurence Greenberg; Werner Stemer; Ralph Locher

(57) ABSTRACT

A rail vehicle has a internal tank installed. A connection opening is provided on a base of the tank into which a tank closure can be inserted from the outside of the tank. The tank closure is mounted on an inner side of an unfolding, sack-shaped container, and an edge of the sack-shaped container is attached to a shaft which lies beneath the tank, in the base of the rail vehicle.

9 Claims, 3 Drawing Sheets

RAIL VEHICLE COMPRISING AN INNER TANK

BACKGROUND OF THE INVENTION

Field of the Invention

In rail vehicles, in particular of regional transport, waste water tanks are, for example, incorporated at the inner side of the carriage. Such tanks may freeze when they are subjected for a very long period of time (several days) to temperatures substantially below 0° C. if they have previously not been emptied by means of a suction installation. Such situations occur exclusively in winter when, for example, rail vehicles remain on a relatively open railway line with no possibility of recovery or are parked in an unplanned manner without an energy supply.

In contrast to a fresh water tank, for environmental protection reasons it is not permitted to empty the waste water tank onto the track in order to prevent the tank from becoming fractured as a result of the formation of ice with subsequent leakage of the thawing tank and contamination of the vehicle inner space.

For the above reasons, waste water tanks have often been constructed with double walls, which involves increased costs. Alternatively, waste water tanks were also constructed on the outer side, without protection from discharge in the event of leakage. However, tanks which are constructed at the outer side and their fitting construction and the connections thereof are more complex, in particular more costly and heavier than tanks which are fitted at the inner side.

In addition in the prior art, the measure has been taken to detect leakages by means of the increased use of sensors and to separate the tank region by means of barriers. However, this also does not afford the possibility of preventing contamination of the rail vehicle in the event of a relatively large quantity of fluid.

BRIEF SUMMARY OF THE INVENTION

Based on this, an object of the invention is to provide a possible method, using simple means, of being able to empty a tank which is fitted internally, for example, for frost protection.

This object is achieved with the rail vehicle mentioned in the introduction by the features of the independent claim.

Accordingly, there is provided on a base of the tank, in particular of the waste water tank, a connection opening into which a tank closure can be inserted from the outer side of the tank, wherein the tank closure is fitted to an inner side of an unfoldable, sack-like container and an edge of the sack-like container is releasably connected to a shaft which is located below the tank in the base of the rail vehicle.

With such a rail vehicle, there is produced an emergency emptying system which is suitable for a waste water tank inside the vehicle or also for an inner tank installation having a waste water tank, a fresh water tank and a tank frame.

When the tank closure is opened, the sack-like container can be unfolded in the direction toward a track and a fluid which is located in a tank can be received by the sack-like container.

The tank closure preferably has a tool receiving member for releasing the tank closure from the connection opening of the tank. If, for example, the tank closure is fitted in the connection opening of the tank by means of a screw connection, this connection can be released by means of a commercially available tool in order to release the connection opening.

Alternatively, the tank closure may be able to be secured in the connection opening of the tank using a rapid-action closure. In this instance, the connection opening is released by actuating the rapid-action closure.

At least one transport loop may be fitted at an outer side of the sack-like container. If, for example, a waste water tank has been completely emptied and all of the waste water is located in the sack-like container, this container can be moved using the transport loops for further disposal of the waste water.

The shaft in the base of the rail vehicle may be able to be closed at the side thereof facing a track by means of a cover. In this instance, the unfoldable, sack-like container is located between the base of the tank and the cover for the shaft.

The cover for the shaft can be fitted to an outer side of the shaft by means of a clamping strip in order to enable simple removal of the cover, where applicable.

The edge of the sack-like container can be fitted to an outer side of the shaft using a clamping strip. This enables the edge of the sack-like container to be released from the shaft after it has been filled.

For simple closure of the sack-like container, a binding device may further be provided at an outer side of the shaft.

Preferably, the sack-like container is constructed so as to be water-tight and high-strength so that it withstands any loads when it is filled and when it is transported.

On the base of the rail vehicle, there may be provided flow barriers which are arranged in such a manner that they are located at the outer side of a face which is determined by the projection of the tank onto the vehicle base. In this manner, a contamination of the vehicle inner space when the tank is emptied is prevented in an effective manner.

BRIEF DESCRIPTION OF THE SEVERAL VIEWS OF THE DRAWING

An embodiment of the invention will be explained in greater detail below with reference to the drawings, in which.

DESCRIPTION OF THE INVENTION

Figure 1:
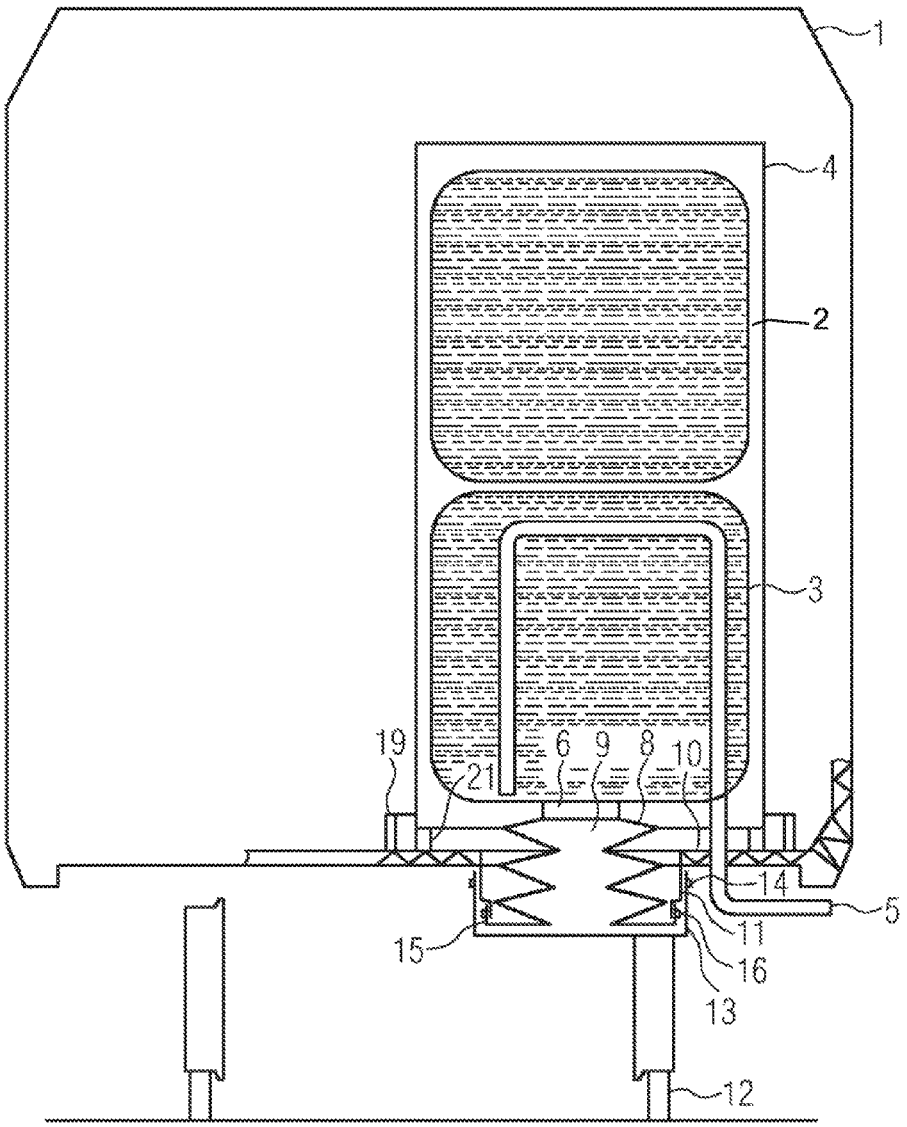
FIG. 1 is a schematic illustration of a rail vehicle having a tank provided internally.

FIG. 1 shows the general structure of a rail vehicle 1 in the inner space of which there are provided vertically one above the other a fresh water tank 2 and therebelow a waste water tank 3 which are retained in a tank frame 4. The waste water tank 3 is provided with a suction line 5 which enables emptying of the waste water tank 3 at a station which is provided for that purpose.

In the embodiment illustrated, both the fresh water tank 2 and the waste water tank 3 are constructed with a single shell.

Figure 2:
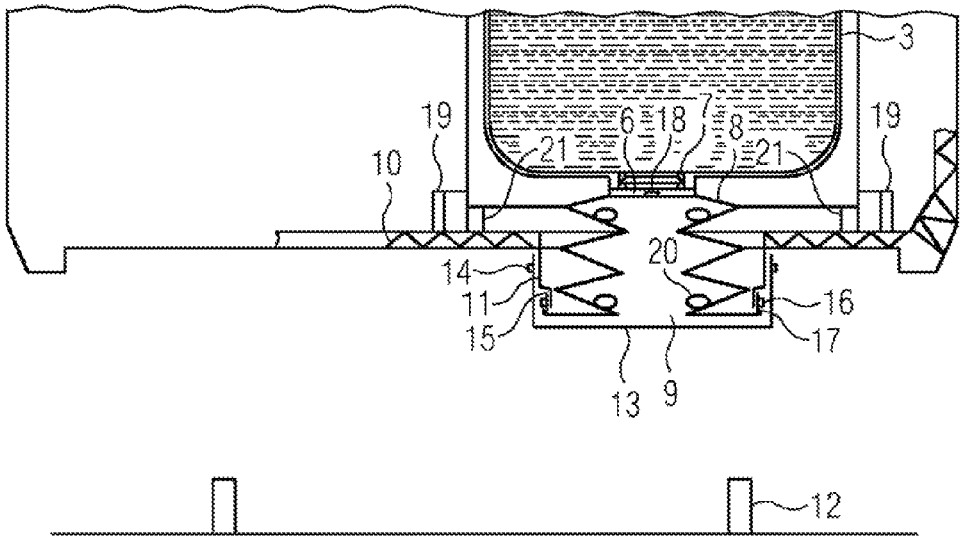
FIG. 2 is a part-view of the rail vehicle of FIG. 1 in the region below the tank with an emergency emptying device in the closed state.
Figure 3:
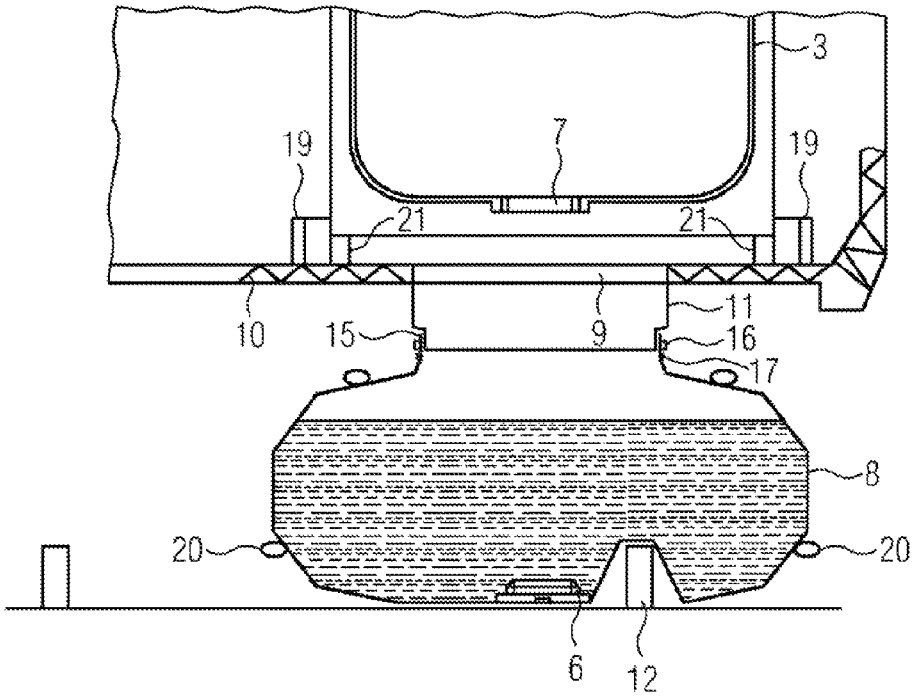
FIG. 3 is a part-view of the rail vehicle of FIG. 1 in the region below the tank with an emergency emptying device in the open state.

At a base side of the waste water tank 3 is a tank closure 6 for a connection opening (cf. FIG. 2), by means of which the waste water tank 3 can be emptied where applicable in the event of an emergency. Such a case occurs, for example, when freezing of the waste water tank 3 may be anticipated, which would lead to the destruction of the waste water tank 3.

The tank closure 6 is fitted to an inner side of an unfoldable, sack-like container 8 which extends below the tank closure 6 in the folded state downward through an opening 9 into a base 10 of the rail vehicle 1 into a shaft 11 which adjoins it in a downward direction. The shaft 11 is closed at the side thereof facing a track 12 with a cover 13 which is fitted to an outer side of the shaft 11 using a clamping strip 14, with small spacing with respect to the lower side of the base 10.

An edge 15 of the sack-like container 8 is releasably fitted to an outer side of the shaft 11 at a lower end of the shaft 11, which end is set back, using a clamping strip 16. Using a sack binder 17, which is also provided below the clamping strip 16 at the outer side of the shaft 11, the sack-like container 8, as will be explained below, can be closed after it has been filled.

Using the emergency emptying device explained above, when the waste water tank 3 is emptied, for example, after a tank breakage and a resultant discharge of fluid, it is possible to proceed as follows:

The rail vehicle 1 is first braked and parked, after which the clamping strip 14 for the cover 13 is released and the cover 13 is removed. The tank closure 6, optionally using a tool which engages in a tool receiving member 18, is then released and allowed to fall in the direction toward the track 12. The sack-like container thereby turns "to the left", the tank closure 6 coming to rest on the track bed.

The waste water tank 3 which has consequently been opened begins to empty, the waste water being discharged supporting an unfolding of the sack-like container 8 between the rail vehicle 1 and the track 12. The waste water can flow completely from the waste water tank 3 into the sack-like container 8. In this instance, barriers 19 between a vehicle shell and a base of the rail vehicle 1 prevent fluid from spreading on the vehicle base 10 and causing significant damage to the rail vehicle. These barriers 19 are located outside a projection face of the tank frame 4 and further toward the outer side than the feet 21 thereof.

After the sack-like container 8 has been filled, the sack binder 17 is released and pushed downward over the sack-like container 8 so that it is closed. Subsequently, there is released the clamping strip 16 with which the edge 15 of the sack-like container 8 was fitted to the outer side of the shaft 11 up to this time. Consequently, the sack-like container 8 is completely released from the rail vehicle 1. Using transport loops 20 which are provided, the filled sack-like container 8 can be rolled laterally from the track 12 and be deposited outside the clearance gauge of the rail vehicle 1. For example, using a track maintenance vehicle having a lifting device, the sack-like container 8 can be collected for disposal.

In another application of the emergency emptying device, damage by a tank breakage of the fresh water tank 2 located above the waste water tank 3 is intended to be minimized. To this end, wherever possible, the waste water tank 3 is first emptied using the suction line 5. Subsequently, the same procedure as above is carried out, as in the application explained above, but now with discharged fresh water and not drawn-off waste water flowing into the sack-like container 8. In this instance, fresh water which has been discharged flows past the waste water tank 3 in the direction toward the sack-like container 8.

As soon as the waste water tank 3 is empty, the sack-like container 8 can be closed in the manner explained above using the sack binder 17, after which the sack-like container 8 can be removed from the rail vehicle 1. Fresh water which continues to flow may optionally be discharged directly onto the track 12.

The invention claimed is:

1. A rail vehicle, comprising:
- a rail vehicle base;
- an inner tank having a tank base and a connection opening formed therein;
- an unfoldable container having an inner side;
- a shaft disposed below said inner tank and supported by said rail vehicle base;
- a cover, said shaft in said rail vehicle base being closed at a side thereof facing a rail track by said cover; and
- a tank closure closing off said connection opening, said tank closure being inserted from an outer side of said inner tank for closing off said connection opening, said tank closure being fitted to said inner side of said unfoldable container and an edge of said unfoldable container being releasably connected to said shaft.

2. The rail vehicle according to claim 1, wherein said tank closure has a tool receiving member for releasing said tank closure from said connection opening of said inner tank.

3. The rail vehicle according to claim 1, wherein said tank closure can be secured in said connection opening of said inner tank using a rapid-action closure.

4. The rail vehicle according to claim 1, further comprising a binding device disposed at an outer side of said shaft, said binding device serving to close said unfoldable container.

5. The rail vehicle according to claim 1, wherein said unfoldable container is water-tight and high-strength.

6. The rail vehicle according to claim 1, further comprising flow barriers disposed on said rail vehicle base, said flow barriers are disposed at an outer side of a face which is determined by a projection of said inner tank onto said rail vehicle base.

7. A rail vehicle, comprising:
- a rail vehicle base;
- an inner tank having a tank base and a connection opening formed therein;
- an unfoldable container having an inner side;
- at least one transport loop fitted on an outer side of said unfoldable container;
- a shaft disposed below said inner tank and supported by said rail vehicle base; and
- a tank closure closing off said connection opening, said tank closure being inserted from an outer side of said inner tank for closing off said connection opening, said tank closure being fitted to said inner side of said unfoldable container and an edge of said unfoldable container being releasably connected to said shaft.

8. The rail vehicle according to claim 7, further comprising a clamping strip, said cover is fitted to an outer side of said shaft by said clamping strip.

9. A rail vehicle, comprising:
- a rail vehicle base;
- an inner tank having a tank base and a connection opening formed therein;
- an unfoldable, container having an inner side;
- a shaft disposed below said inner tank and supported by said rail vehicle base;
- a clamping strip, said edge of said unfoldable container being fitted to an outer side of said shaft using said clamping strip; and
  - a tank closure closing off said connection opening, said tank closure being inserted from an outer side of said inner tank for closing off said connection opening, said tank closure being fitted to said inner side of said unfoldable container and an edge of said unfoldable container being releasably connected to said shaft.

* * * * *